US007316264B2

(12) United States Patent
Lai et al.

(10) Patent No.: US 7,316,264 B2
(45) Date of Patent: Jan. 8, 2008

(54) HEAT PIPE

(75) Inventors: Yaw-Huey Lai, Taipei County (TW); Chih Ming Liu, Nantou County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 189 days.

(21) Appl. No.: 11/202,264

(22) Filed: Aug. 12, 2005

(65) Prior Publication Data

US 2006/0283576 A1 Dec. 21, 2006

(30) Foreign Application Priority Data

Jun. 21, 2005 (TW) ..... 94210450 U

(51) Int. Cl.
*F28D 15/00* (2006.01)
*H05K 7/20* (2006.01)

(52) U.S. Cl. ..... 165/104.26; 165/104.21

(58) Field of Classification Search ..... 165/104.21, 165/104.26; 361/700
See application file for complete search history.

(56) References Cited

U.S. PATENT DOCUMENTS

| | | | | |
|---|---|---|---|---|
| 4,903,761 | A * | 2/1990 | Cima | 165/104.25 |
| 4,934,160 | A * | 6/1990 | Mueller | 62/515 |
| 6,330,907 | B1 * | 12/2001 | Ogushi et al. | 165/104.26 |
| 2005/0230085 | A1 * | 10/2005 | Valenzuela | 165/104.26 |
| 2006/0011328 | A1 * | 1/2006 | Hui-Chun | 165/104.26 |

* cited by examiner

*Primary Examiner*—Tho Duong
(74) *Attorney, Agent, or Firm*—Bacon & Thomas, PLLC

(57) ABSTRACT

A heat pipe includes a tubular member, a capillary wick, and a liquid. The tubular member has a plurality of capillary ditches formed on an internal sidewall thereof. The capillary wick is disposed on the internal sidewall of the tubular member and located on openings of the capillary ditches for covering and sealing the ditches. The liquid is contained inside the tubular member. The capillary wick and ditches provide the liquid with larger cross-sectional area for the capillary action to enhance guidance of the liquid and to further enhance the thermally conductive efficiency.

1 Claim, 8 Drawing Sheets

HEAT PIPE

BACKGROUND OF THE INVENTION

1. Field of the Invention

The present invention relates generally to heat-dissipating devices, and more particularly, to a heat pipe.

2. Description of the Related Art

A conventional heat pipe is usually composed of a sealed tubular member, a capillary wick mounted on an internal sidewall of the tubular member, and adequate liquid, employing the liquid-vapor variation and the flowage of the liquid for thermal conduction. In practical operation, water located at a heated section of the tubular member is heated to be transformed into vapor, the vapor is then diffused to a condensed section of the tubular member to be transformed into water, and then the water is returned to the heated section through the capillary action generated by the capillary wick, thus completing heat exchange. Such endless cycles of endothermic and exothermic reactions can effect rapid thermal conduction.

Referring to FIGS. 5 and 6, a conventional heat pipe 80 includes a plurality of ditches 82 formed on an internal sidewall thereof for capillary action. The capillary action of the ditches 82 enables flowage of liquid contained therein to cause liquid-vapor equilibrium and to further effect rapid thermal conduction.

However, the ditches 82 of the aforesaid heat pipe 80 have tiny cross-sectional area to cause less refluence of the water, thus incurring worse thermal conduction.

Referring to FIGS. 7 and 8, another conventional heat pipe 90 includes a capillary layer 94 mounted at an internal sidewall thereof for capillary action. The capillary layer 94 is made of sintered metallic grains and gaps are formed among the metallic grains. The capillary action is generated in the gaps to guide the liquid contained in the heat pipe 90 to further cause the liquid-vapor equilibrium, equally effecting rapid thermal conduction.

Although the cross-sectional area of the metallic grains of the aforesaid heat pipe 90 for capillary action is larger than that of the heat pipe 80, it is still insufficient for thermal conduction, thus requiring further improvement.

SUMMARY OF THE INVENTION

The primary objective of the present invention is to provide a heat pipe, which has better thermally conductive efficiency than the prior art.

The foregoing objective of the present invention is attained by the heat pipe, which is composed of a tubular member, a capillary wick, and a liquid. The tubular member includes a plurality of capillary ditches formed on an internal sidewall thereof. The capillary wick is disposed on the internal sidewall of the tubular member and outside the capillary ditches. The liquid is contained inside the tubular member. The capillary wick and ditches provide the liquid with larger cross-sectional area for the capillary action to enhance guidance of the liquid and to further enhance the thermally conductive efficiency.

DETAILED DESCRIPTION OF PREFERRED EMBODIMENTS

Figure 1:
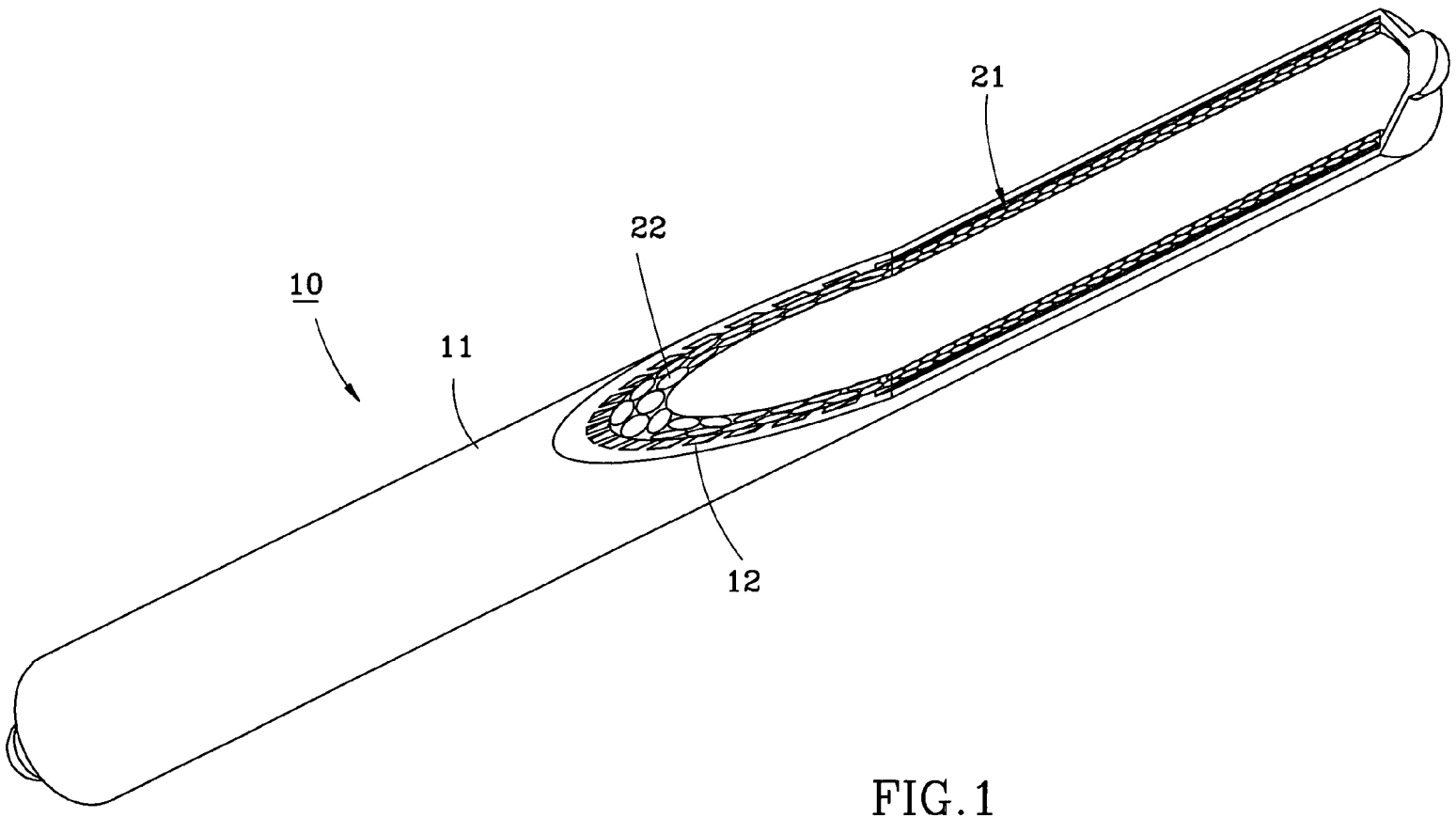
FIG. 1 is a partially sectional and perspective view of a preferred embodiment of the present invention.
Figure 2:
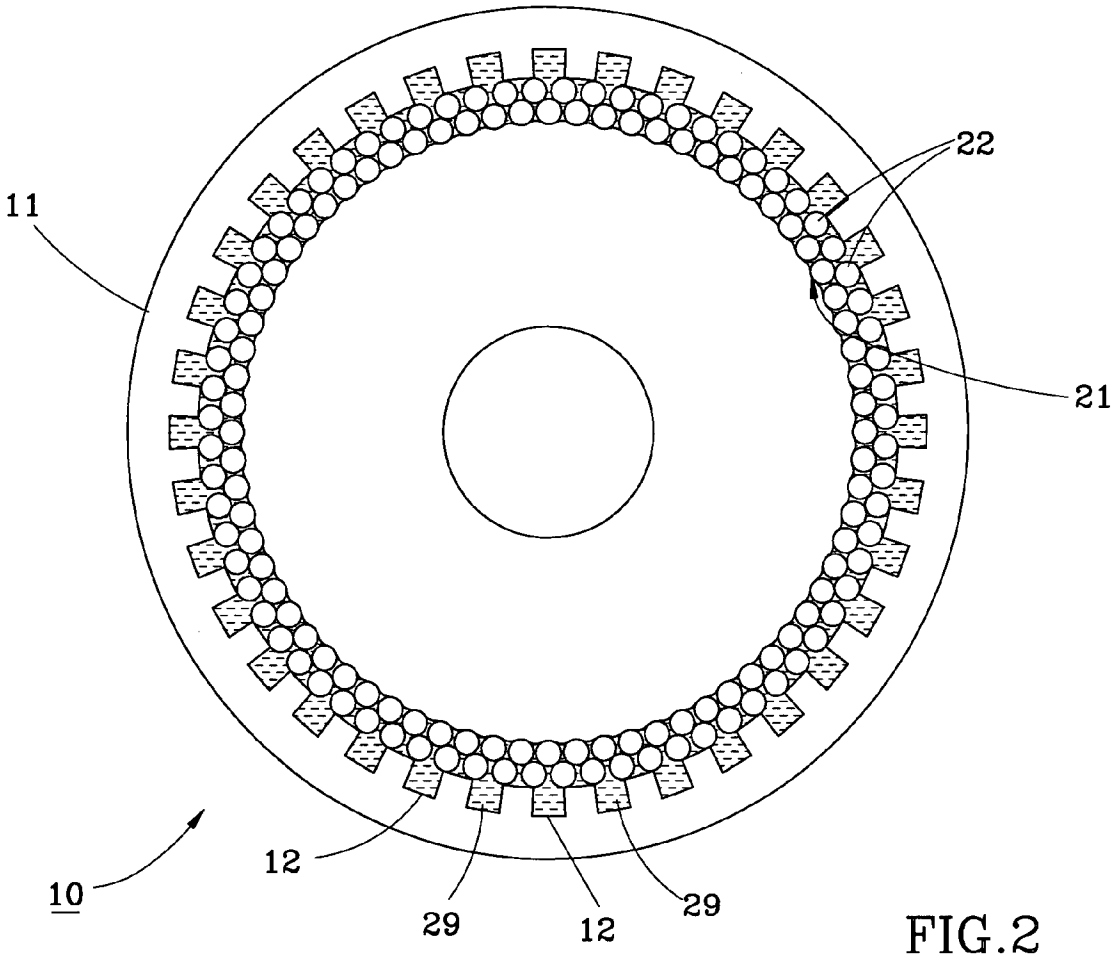
FIG. 2 is a sectional view of the preferred embodiment of the present invention.

Referring to FIGS. 1 and 2, a heat pipe 10 constructed according to a first preferred embodiment of the present invention is composed of a tubular member 11, a capillary wick 21, and a liquid 29.

The tubular member 11 includes a plurality of capillary ditches 12 formed on an internal sidewall thereof.

The capillary wick 21 is disposed on the internal sidewall of the tubular member 11 and located on openings of the capillary ditches 12 to cover and seal the capillary ditches 12. The capillary wick 21 is made of sintered metallic grains 22 for generating capillary passages at gaps formed among the metallic grains 22. Each of the metallic grains 22 has a diameter larger than a width of each of the capillary ditches 12 to prevent the capillary wick 21 from falling into the capillary ditches 12.

The liquid 29 is contained in the tubular member 11 can flow along the capillary passages of the capillary wick 21 and the capillary ditches 12 for rapid flowage through the capillary action.

While the heat pipe 10 is operated, the liquid 29 can employ the capillary action generated by the capillary wick 21 and ditches 12 to flow inside the tubular member 11, thus having double cross-sectional area for the capillary action than either one single capillary wick or ditch of the above-mentioned conventional heat pipe to cause more effective guidance of the liquid to enlarge the refluence of the liquid and to further enable better thermally conductive efficiency. Besides, the larger diameter of the metallic grain of the capillary wick 21 than the width of each capillary ditch 12 keeps the metallic grains from falling into the ditches 12, such that the ditches 12 keep functioning well other than malfunction incurred by obstruction of the metallic grains 22.

Figure 3:
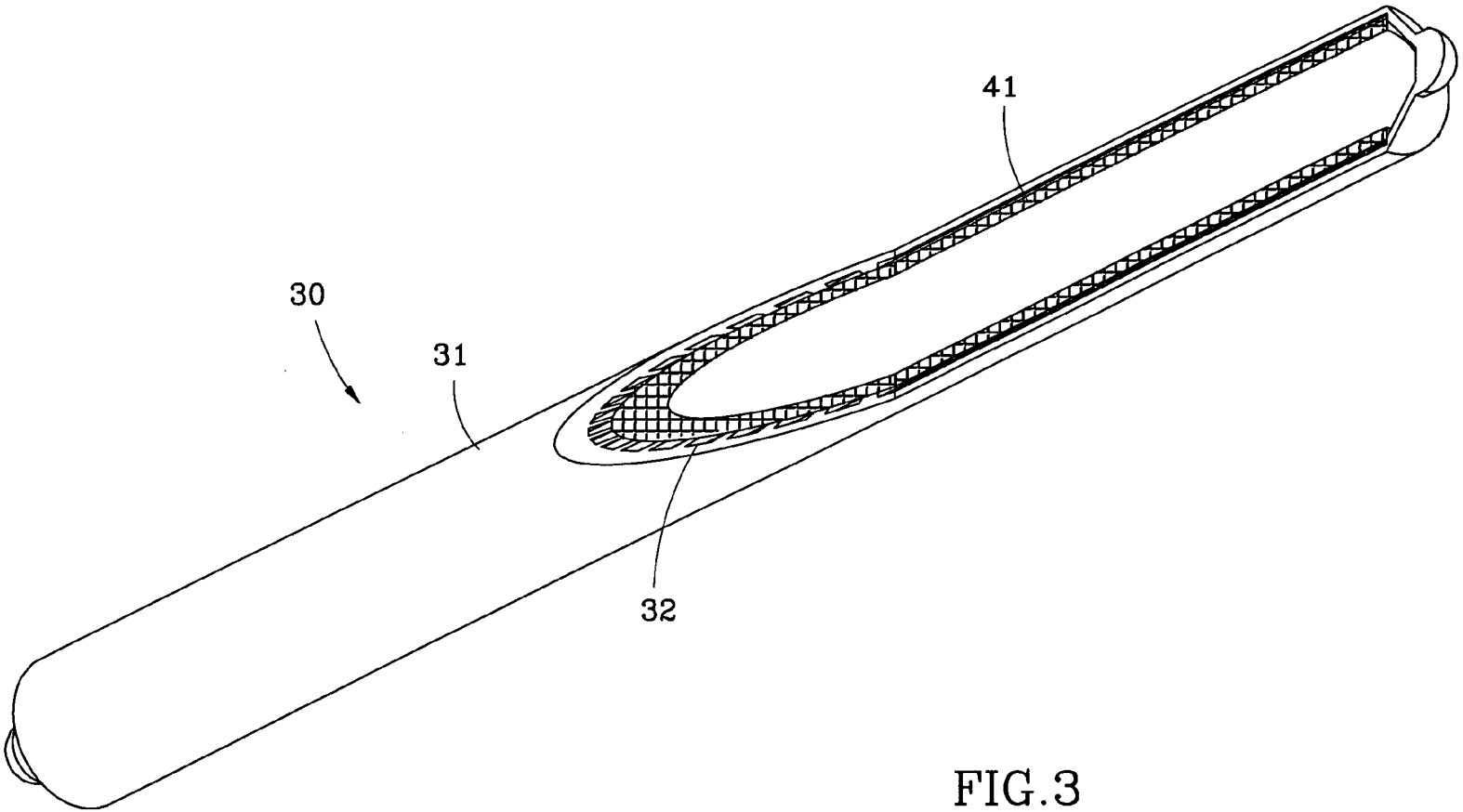
FIG. 3 is a partially sectional and perspective view of a second preferred embodiment of the present invention.
Figure 4:
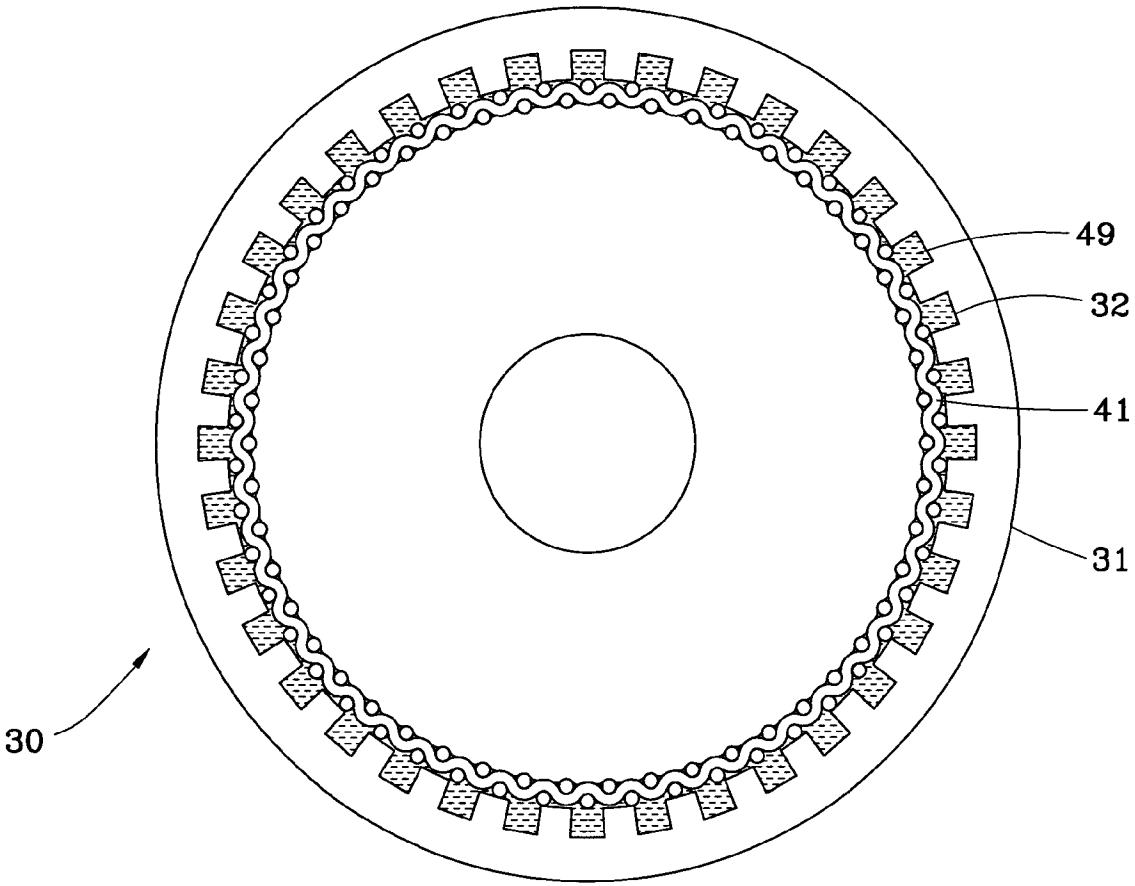
FIG. 4 is a sectional view of the second preferred embodiment of the present invention.
Figure 5:
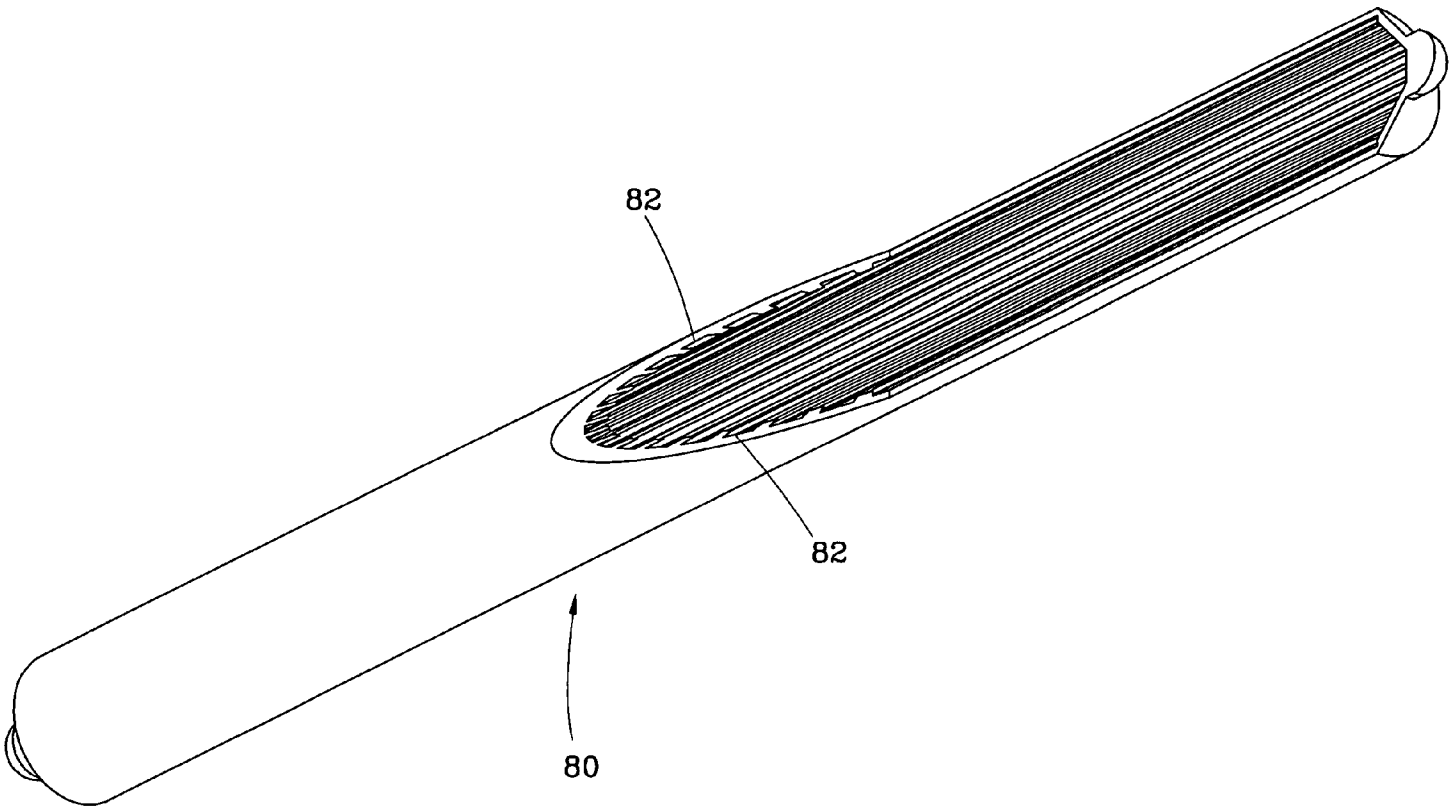
FIG.5 PRIOR ART
FIG. 5 is a partially sectional and perspective view of a conventional heat pipe.
Figure 6:
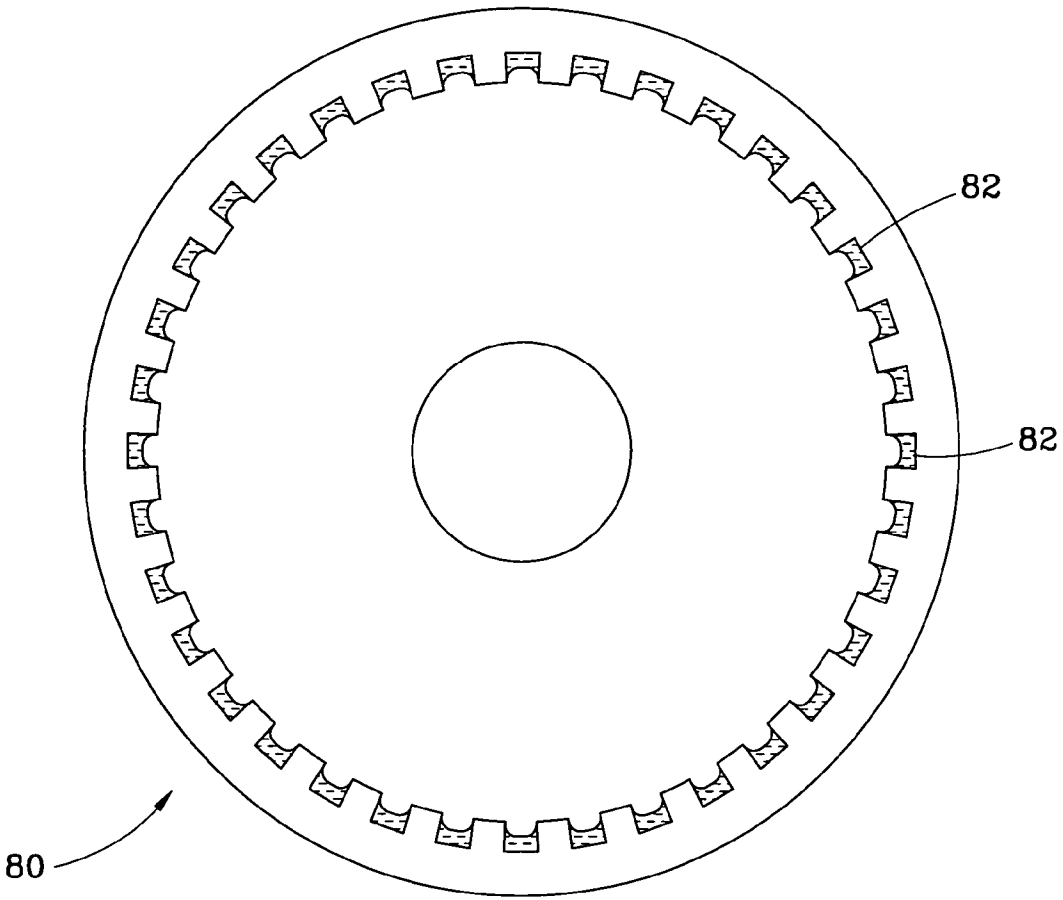
FIG. 6 PRIOR ART
FIG. 6 is a sectional view of the conventional heat pipe.
Figure 7:
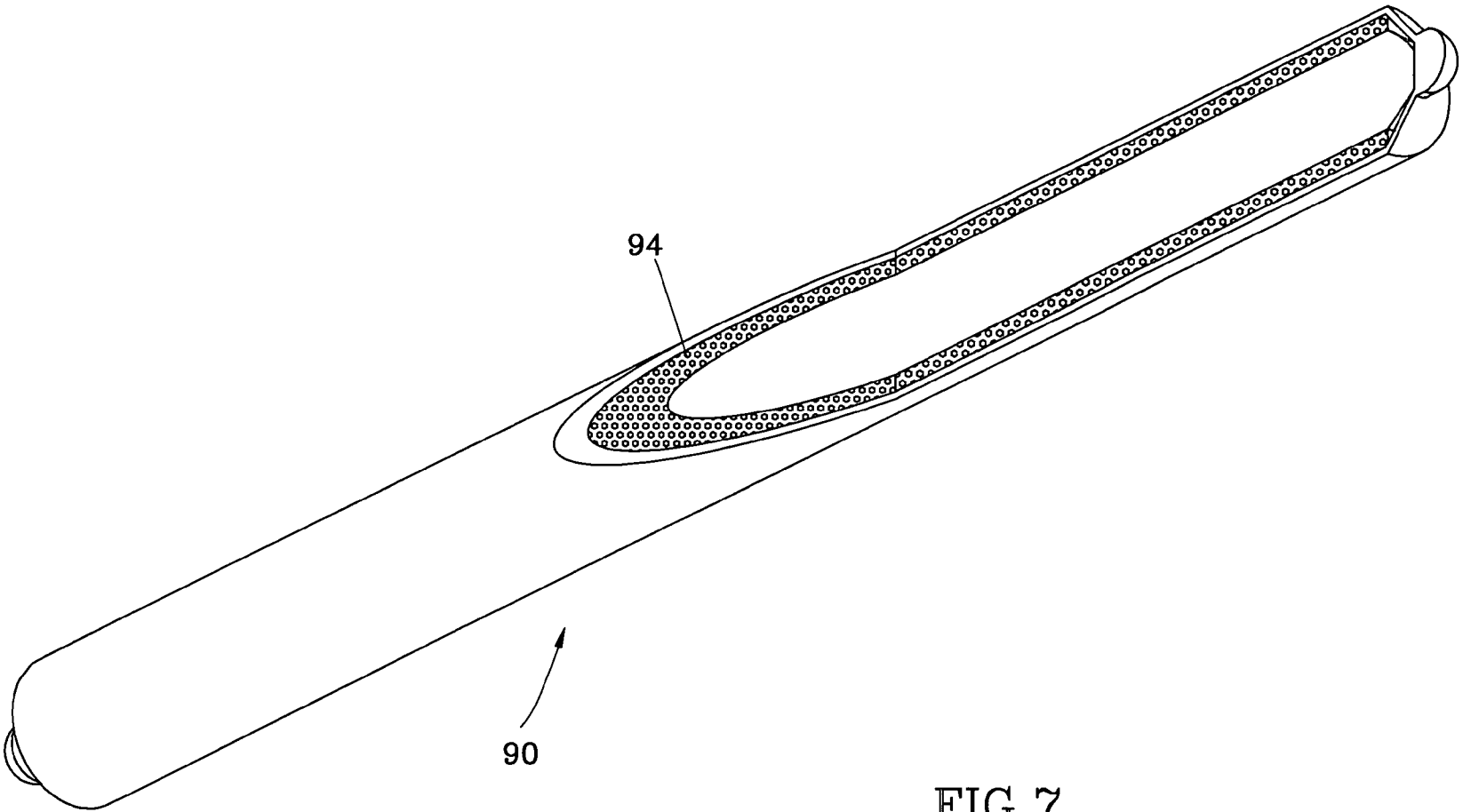
FIG.7 PRIOR ART
FIG. 7 is another partially sectional and perspective view of a conventional heat pipe.
Figure 8:
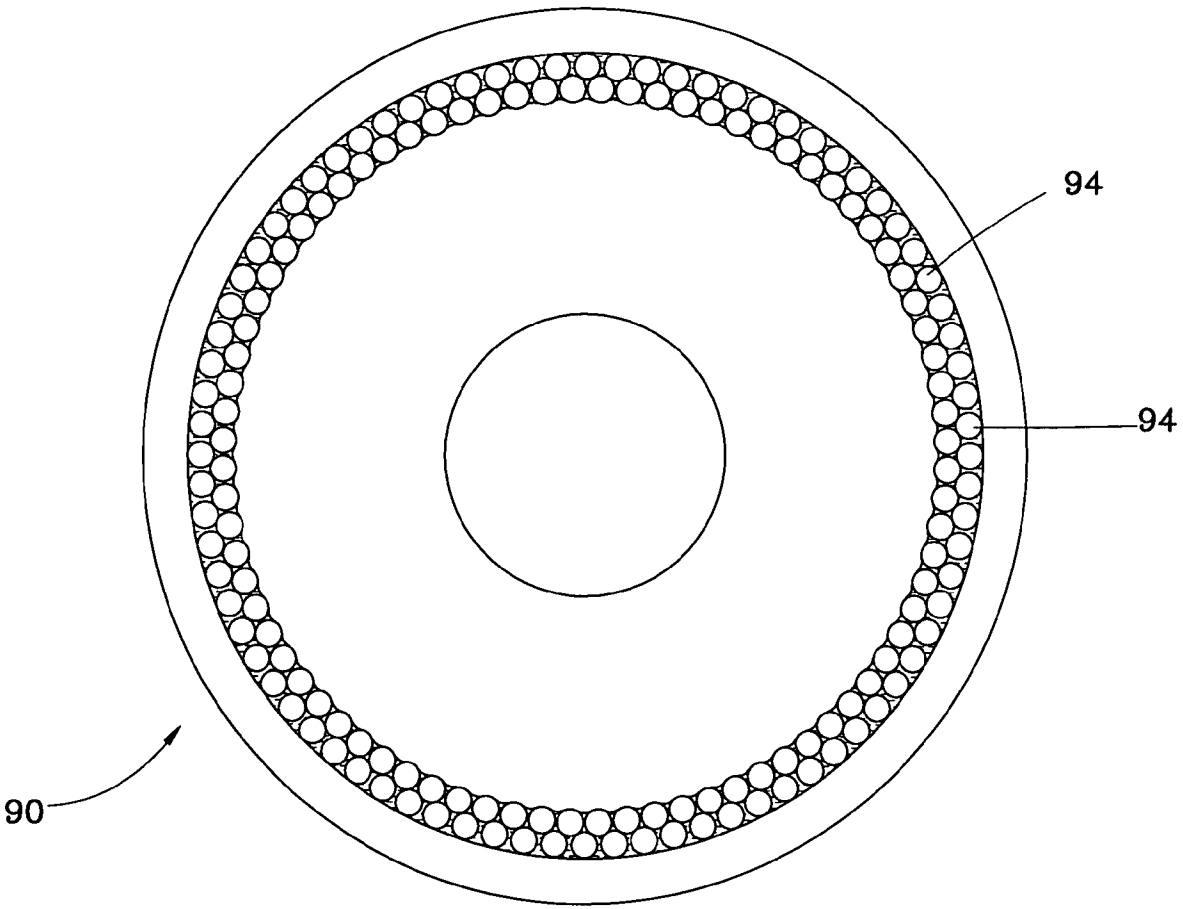
FIG.8 PRIOR ART
FIG. 8 is another partially sectional and perspective view of the conventional heat pipe.

Referring to FIGS. 3 and 4, the heat pipe 30 constructed according to a second preferred embodiment of the present invention is composed of a tubular member 31, a capillary wick 41, and a liquid 49.

The tubular member 31 includes a plurality of capillary ditches 32 formed on an internal sidewall thereof.

The capillary wick 41 is a tubular metallic mesh, disposed on the internal sidewall of the tubular member 31, and located on openings of the capillary ditches 32 to cover and seal the ditches 32.

The liquid 49 is contained in the tubular member 31 for rapid flowage, through the capillary action, along the capillary ditches 32 and gaps formed in the metallic mesh of the capillary wick 41.

Because the heat pipe 30 of the second embodiment is the same in operation as the heat pipe 10 of the first embodiment of the present invention, no further recitation is necessary. The cross-sectional area for the capillary action, in this embodiment, is composed of the capillary ditches 32 and wick 31 to be totally larger than the prior art and to effect better fluid guidance.

In conclusion, the present invention has double cross-sectional area of the capillary wick and ditches for the capillary action, thus having better liquid guidance, more liquid refluence, and better thermally conductive efficiency than the prior art.

What is claimed is:

1. A heat pipe comprising:

a tubular member having a plurality of capillary ditches formed on an internal sidewall thereof;

a capillary wick disposed on said internal sidewall of said tubular member and located on openings of said capillary ditches for covering and sealing said ditches; and a liquid contained in said tubular member;

wherein said capillary wick is made of sintered metallic grains, each of said metallic grains being larger in diameter than a width of each of said capillary ditches.

* * * * *